US005785362A

United States Patent [19]

Nadherny

[11] Patent Number: 5,785,362

[45] Date of Patent: Jul. 28, 1998

[54] CAM-OPERATED HATCH COVER LOCK

[75] Inventor: Rudolph E. Nadherny, Golden, Mo.

[73] Assignee: Ireco, Inc., Chicago, Ill.

[21] Appl. No.: 794,847

[22] Filed: Feb. 4, 1997

[51] Int. Cl.[6] ..... B61D 39/00; E05C 3/30

[52] U.S. Cl. ..... 292/98; 292/124; 292/197; 292/256.5; 292/257; 105/377.11

[58] Field of Search ..... 292/98, 100, 124, 292/126, 256.5, 257, 197, 200; 105/377.7, 377.11

[56] References Cited

U.S. PATENT DOCUMENTS

| | | | |
|---|---|---|---|
| 691,752 | 1/1902 | Dawley . | |
| 768,530 | 8/1904 | King . | |
| 1,171,016 | 2/1916 | Barger | 292/DIG. 20 |
| 2,405,040 | 7/1946 | Madland | 105/377.11 |
| 2,846,258 | 8/1958 | Granberg | 292/DIG. 20 |
| 3,848,912 | 11/1974 | Jensen et al. . | |
| 3,884,514 | 5/1975 | Praska . | |
| 4,000,703 | 1/1977 | Halliar | 105/377.11 |
| 4,062,576 | 12/1977 | Jennings et al. | 292/257 |
| 4,094,542 | 6/1978 | Siblik . | |
| 4,307,670 | 12/1981 | Nadherny . | |
| 4,365,832 | 12/1982 | Treppler | 105/377.11 |
| 5,314,218 | 5/1994 | Nadherny . | |

FOREIGN PATENT DOCUMENTS

| | | | |
|---|---|---|---|
| 785176 | 5/1968 | Canada | 292/197 |

*Primary Examiner*—Kenneth J. Dorner
*Assistant Examiner*—Robert G. Santos
*Attorney, Agent, or Firm*—Lockwood, Alex, FitzGibbon & Cummings

[57] ABSTRACT

A hatch cover locking mechanism for securing a roof member onto a hatch opening of a railway hopper car is provided. The hatch cover lock utilizes camming engagement between an operation handle and a keeper member in order to lock or unlock the keeper member over a hinge pin associated with the hatch roof member. A hook rotates along an orientation generally the same as that of the keeper, and the hook retains the hinge pin as desired when the hinge pin is not locked down by the keeper.

25 Claims, 7 Drawing Sheets

54
48
53
37

56
54
48
53
55
37

29
43
10
12
66
56
54
51
52
55
37
53
12
11

54
56
48
53
37

CAM-OPERATED HATCH COVER LOCK

BACKGROUND OF THE INVENTION

The field of this invention is one which relates generally to a hatch cover lock for securely attaching a cover to an otherwise open hatch. More particularly, the invention relates to a cam-operated hatch cover lock mechanism for securing a removable hatch cover to a railway hopper car so as to securely hold down the hatch cover. The invention incorporates a camming action and exhibits important advantages over previous hatch cover lock mechanisms.

DESCRIPTION OF RELATED ART

Railway cars include those commonly referred to as covered hopper cars. These are widely used in the railroad industry for transporting various products and materials such as grains across country. These covered hopper cars are generally trough-like railway cars having an interior storage area and openings or hatches through the top or roof of the hopper car. Generally, the loaded material is removed from the hopper car through one or more openings in the bottom section of the hopper car.

A single hopper car can have several hatch covers which are used to close the openings in the top of the hopper car so as to prevent spillage and entry of unwanted materials and possible infestation into the hopper car during transportation and storage of the products or materials in the hopper car. Often, the hatch or hatches extend the entire length of the hopper car. When a lengthy hatch is to be covered, it is generally desirable to use multiple hatch covers. Even so, hatch covers tend to be rather large in area covered, and often any given hatch cover requires multiple locking devices to be certain that the hatch cover is securely locked down.

A typical railway car hatch has an upstanding coaming along its periphery. It is usually required that the hatch cover, when closed, seats tightly over the coaming, typically in association with a sealing gasket. A properly operating hatch cover lock will compress this gasket onto the upstanding coaming. In this manner, the hatch covers are securely sealed around their perimeters. This secure seal is maintained until such time as it is desired to open the hatch, and hatch cover locks should be then openable in an advantageous manner.

Many hatch cover assemblies have one or more locations which allow a hatch cover locking mechanism to grasp and hold down the cover. These grasping locations can be spaced along the length of the hatch cover, in many cases along both longitudinal sides of the hatch cover. Generally, this allows for the hatch cover to be completely removable and for it to be openable from either of its longitudinal sides. In a typical hatch cover arrangement, the grasping locations include a narrow member which is grasped by the hatch cover lock mechanism. These narrow members can be hinge pins and the like.

A previous arrangement of a hatch cover lock mechanism grasps one of these narrow members positioned along the periphery of a hatch cover. Nadherny U.S. Pat. No. 5,314,218 describes hatch cover lock mechanisms for use in connection with hopper car hatch covers. This patent, which is incorporated by reference hereinto, illustrates hopper cars of the type upon which the present invention can be secured. Certain hinge pin arrangements are also shown in this prior patent.

A typical hinge pin assembly allows the hold-down component for the hatch cover to function either as a pin component of a hinge along which pivoting can take place or alternatively as a point of attachment and detachment by which the hopper cover is securely closed or opened as desired. A useful advantage of hopper covers that can be opened from either longitudinal side of the hatch opening is allowing railroad personnel the working flexibility which allows for opening of the hatch cover from either side as desired. Such opening convenience is apparent when obstructions are present which can vary depending upon operating conditions and locations of particular components.

A hatch cover lock and hinge as shown in U.S. Pat. No. 5,314,218 relies upon an over-center action by which a keeper is moved vertically down (for securing) or up (for unsecuring) a hinge pin type of member associated with a hopper car hatch cover. The present invention imparts certain improvements to a hatch cover lock structure of this type. With the prior hatch cover lock and hinge, the keeper must be rotated out of the way. This requires a certain clearance which limits the versatility of the hatch cover lock to accommodate hatch covers and hinge pins of different sizes and configurations. Access to the hook of this prior lock mechanism, which must be pushed toward the hopper car trough or cover to open it, can also be difficult under certain circumstances and with certain cover components. Also, in the event that the spring which biases the hook were to break, the hook could become inoperative.

SUMMARY OF THE INVENTION

The hatch cover lock mechanism of the invention is for securing an openable roof member of a railway hopper car and is of a cam-operated type. Its camming action translates familiar handle member rotation into guided movement of a keeper member between a locked position and an unlocked position. Such camming action provides gradual release of the keeper member when desired. The keeper, when locked, engages a narrow rod or hinge pin associated with a hatch cover of the railway hopper car in order to lock down the hatch cover. This engagement occurs when the hinge pin type of member is at a receptor location or area within the hatch cover lock. A hook member automatically provides access of the hinge pin type of member to this receptor location and automatically secures same at this receptor location, typically functioning as a temporary hold-down member, either before or after the more secure and rigorous hold-down or locking function is accomplished by the keeper member. In the preferred arrangement which is illustrated, both the keeper member and the hook member rotate away from the hopper car trough or cover during opening, thereby reducing any likelihood of unwanted interference of the keeper or hook members with virtually any size or shape of hatch cover component, including the hinge pin types of members or the components to which each hinge pin type of member is secured.

It is accordingly a general object of the present invention to provide an improved hatch cover lock and hinge assembly for securing an openable roof member for selectively securing a hatch cover to a railway hopper car.

Another object of the present invention is to provide an improved hatch cover lock mechanism which is well-suited for two-way operation wherein a hatch cover for a railway hopper car can be opened from either longitudinal side of the cover.

Another object of this invention is to provide an improved hatch cover lock assembly for securing a fully removable roof member or a plurality of removable roof members over a hatch of a railway hopper car.

Another object of the present invention is to provide an improved hatch cover lock and hinge which is characterized by camming action for positively directing the opening and closing of a lock keeper member.

Another object of this invention is to provide an improved hatch cover lock and hinge assembly which can accommodate a wide variety of sizes and designs of hatch cover hinge pins and associated mounting structures, providing enhanced versatility especially insofar as hinge pin design is concerned.

Another object of the present invention is to provide an improved hatch cover lock and hinge assembly which provides increased clearance when disengaging the hook from a hinge pin type of member of a hatch cover of a railway hopper car.

Another object of this invention is to provide an improved hatch cover lock having a generally open inside structure which reduces the likelihood of debris buildup which could lead to improper operation of the hatch cover lock and hinge.

Another object of the present invention is to provide an improved hatch cover lock and hinge which addresses concerns regarding possible tampering with components of the hatch cover lock and hinge.

These and other objects, advantages and features of the present invention will be apparent from and clearly understood through a consideration of the following detailed description.

BRIEF DESCRIPTION OF THE DRAWINGS

In the course of this description, reference will be made to the attached drawings, wherein.

DESCRIPTION OF THE PREFERRED EMBODIMENTS

Figure 1:
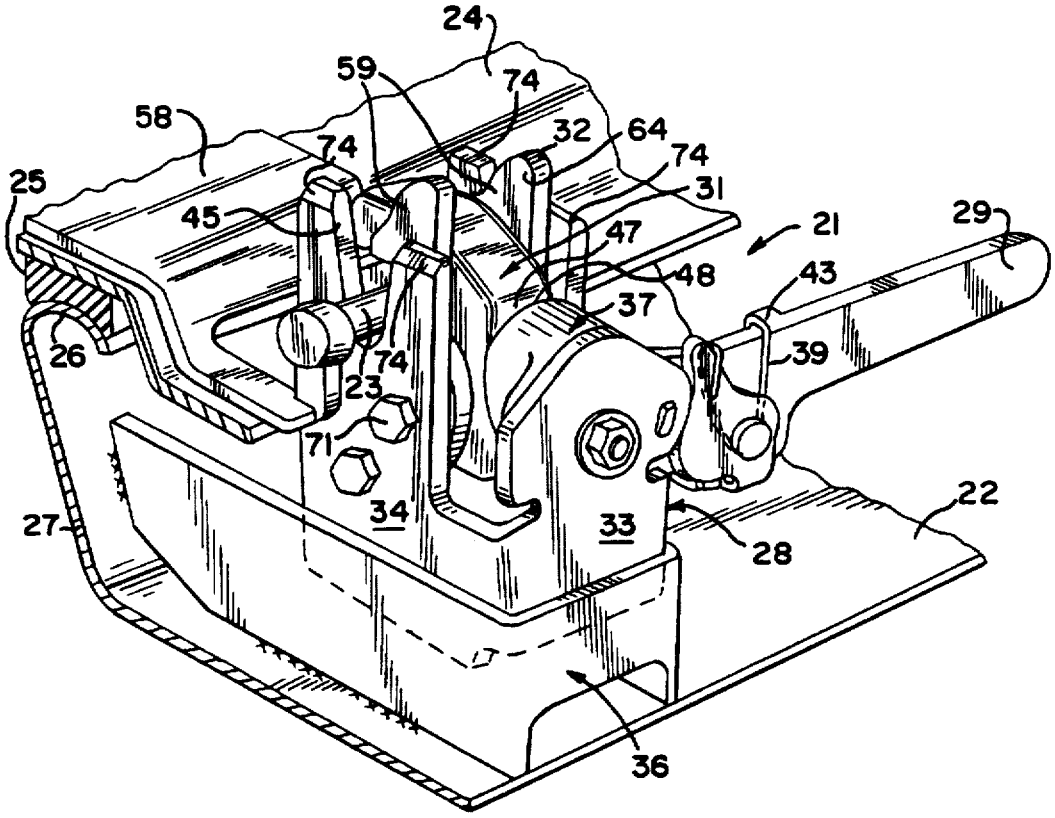
FIG. 1 is a perspective view of the preferred embodiment of the hatch cover lock according to the present invention.
Figure 2:
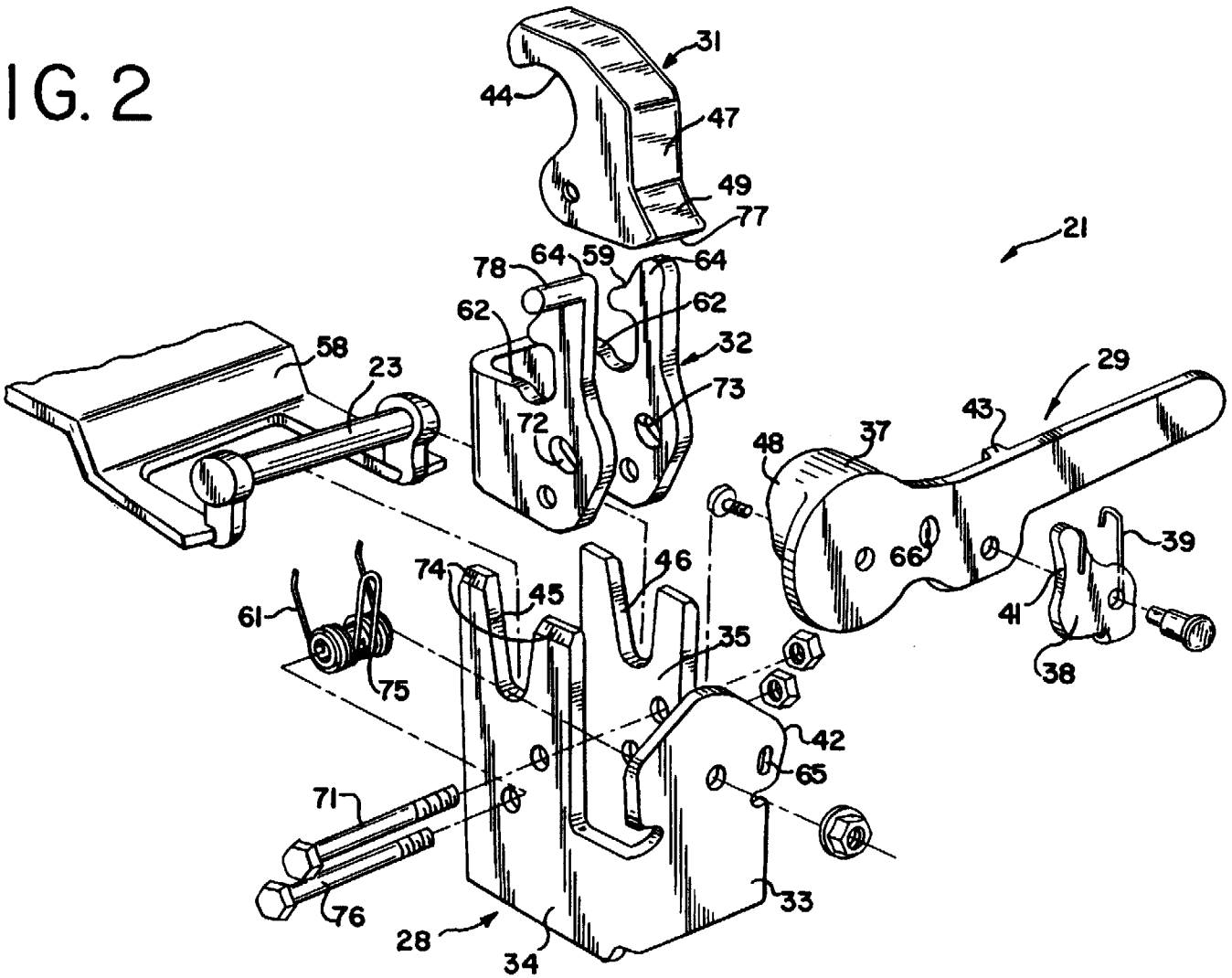
FIG. 2 is an exploded perspective view of the hatch cover lock illustrated in FIG. 1.

A hatch cover lock assembly, generally designated as 21 in FIG. 1 and FIG. 2, is shown mounted on roof 22 of a covered hopper car (not shown). FIG. 1 further shows the hatch cover lock assembly 21 in locked engagement with a hinge pin 23 in order to securely lock down a hopper cover 24, thereby compressing a sealing gasket 25 over an upstanding coaming 26 of the hopper cover hatch. It will be appreciated that wall 27 partially defines a hatch through which grain and like enters the hopper car.

With more particular reference to the illustrated hatch cover lock assembly 21, same includes a housing member, generally designated as 28, to which are mounted each of a handle member, generally designated as 29, a keeper member, generally designated as 31, and a retainer hook member, generally designated as 32.

Figure 3:
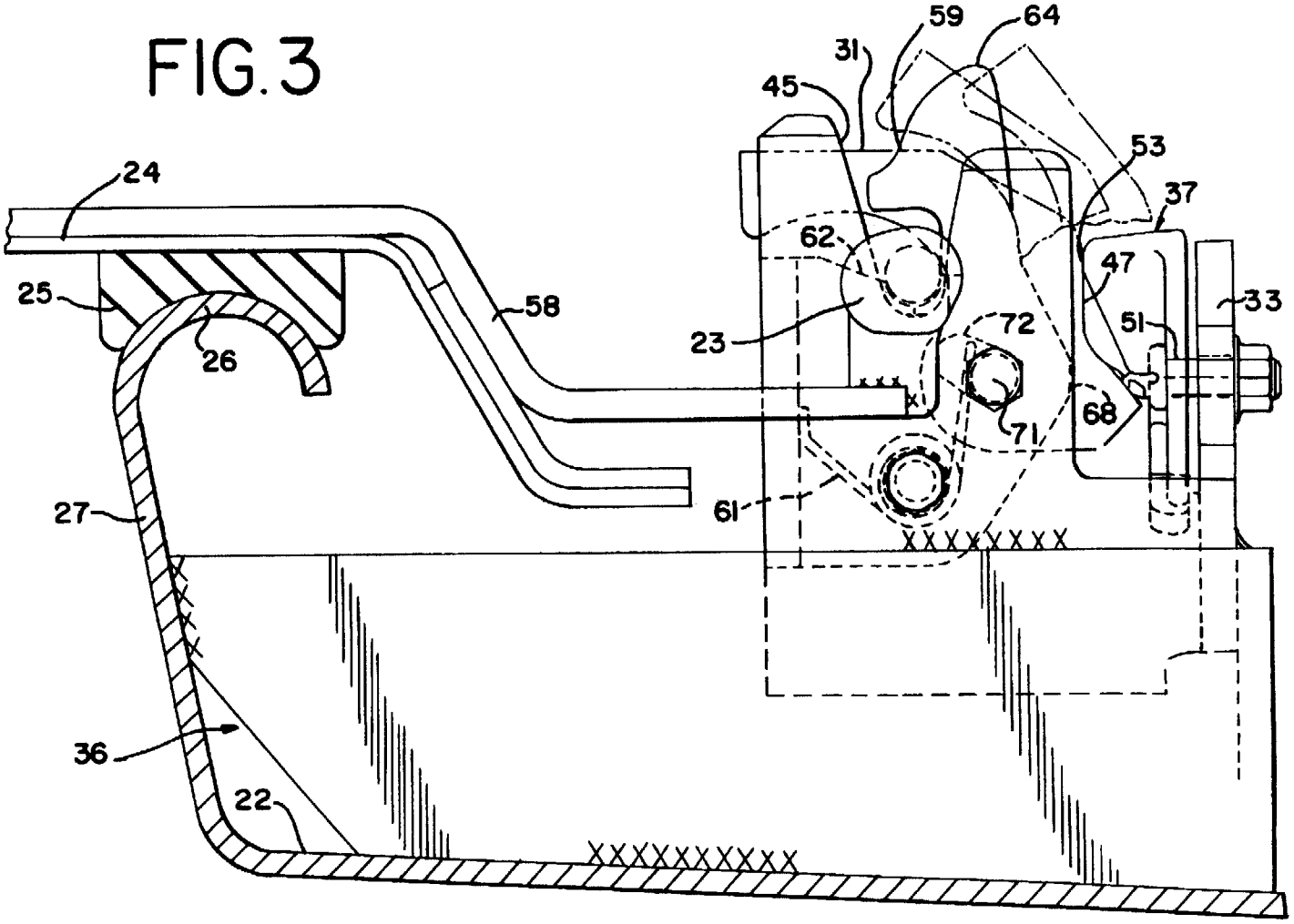
FIG. 3 is a side elevational view of the illustrated hatch cover lock, showing a typical application onto a railway hopper car and a typical interaction with hopper cover components.

As perhaps best illustrated in FIG. 2, the housing member 28 that is illustrated is a three-sided structure having a front panel 33 and side panels 34 and 35. Preferably, this housing member is of unitary construction as shown. Housing member 28 is secured, such as by welds which are illustrated in FIG. 3, to the hopper car. In the disclosed illustration, this securement is through an adjusting bracket member, generally designated as 36 (FIG. 3). It will be appreciated that particulars of such securement will vary depending upon the precise configuration of the hopper car and of its hatches.

Handle member 29 is rotatably mounted to the front panel 33 of the housing member 28. Handle member 29 includes a cam component 37 having a curved cam surface 48 described in greater detail herewithin. A handle lock 38 and accompanying handle lock spring 39 are pivotally mounted to the handle member 29 and serve to lock the handle in its closed orientation. More specifically, a bearing surface 41 of the handle member engages protruding surface 42 of the housing member 28 in order to limit counter-clockwise rotation (as viewed in FIG. 4) of the handle member 29 after same has reached the closed or locked orientation illustrated in FIG. 4. This locking function generally will occur even without the presence of the handle lock spring 39, but such operation depends upon gravity forces on the handle 38, which forces can be overcome by dirt build-up, paint and/or debris. A stop 43 can be included in order to prevent possible slippage of the handle lock spring 39.

Keeper member 31 is rotatably mounted between opposing side panels 34 and 35 of the housing member. Keeper member 31 has a locking surface 44. When the keeper member 31 is locked as discussed elsewhere herein, the locking surface 44 secures the hinge pin 23 at a receptor location or area, thereby locking the hinge pin 23 within the hatch cover lock apparatus. Also assisting in defining the receptor location are surfaces of the housing member. More particularly, in the illustrated preferred embodiment, each side panel 34 and 35 of the housing member has a V-notch 45 and 46, respectively. Such V-notches help to guide the hinge pin into proper locked position. The receptor location is also generally defined by a portion of the hook member 32, as generally discussed herein. It will be appreciated that access to the receptor location or area is substantially open and unencumbered. As a result, the illustrated hatch cover lock assembly can accommodate virtually any design of hinge strapping so as to suit the needs and designs of any number of hatch cover manufacturers.

In an advantageous arrangement, the upper portions of the side panels 34, 35 can include chamfers 74 which assist in guiding or directing each hinge pin end of the hatch cover or the like into the receptor location. Alternatively or additionally, the upper portions of the side panels 34, 35 can be bent inwardly to facilitate funneling or centering of each hinge pin end as it moves onto the hatch cover lock assembly.

Keeper member 31 has a cam follower surface having an upper cam follower surface 47. In operation, the curved cam surface 48 of the handle 29 slides over the cam follower surface to gradually and positively rotate the keeper member 31. FIG. 7 illustrates the open orientation of the device. A lower cam surface 49 of the keeper member 31 engages a generally central, thickest portion of the curved cam surface 48 of the keeper cam component 37. As the handle rotates from the open position of FIG. 7 (also shown in solid in FIG. 6), the engagement between the curved cam surface 48 and the lower cam follower surface 49 is gradually replaced by engagement between the curved cam surface 48 and the upper cam follower surface 47 of the keeper member 31. This gradual change is completed when the handle member 29 is moved to the locked or closed orientation. This relationship can be generally seen in FIG. 1 and in FIG. 5.

Figures 9, 10, 11, 12:
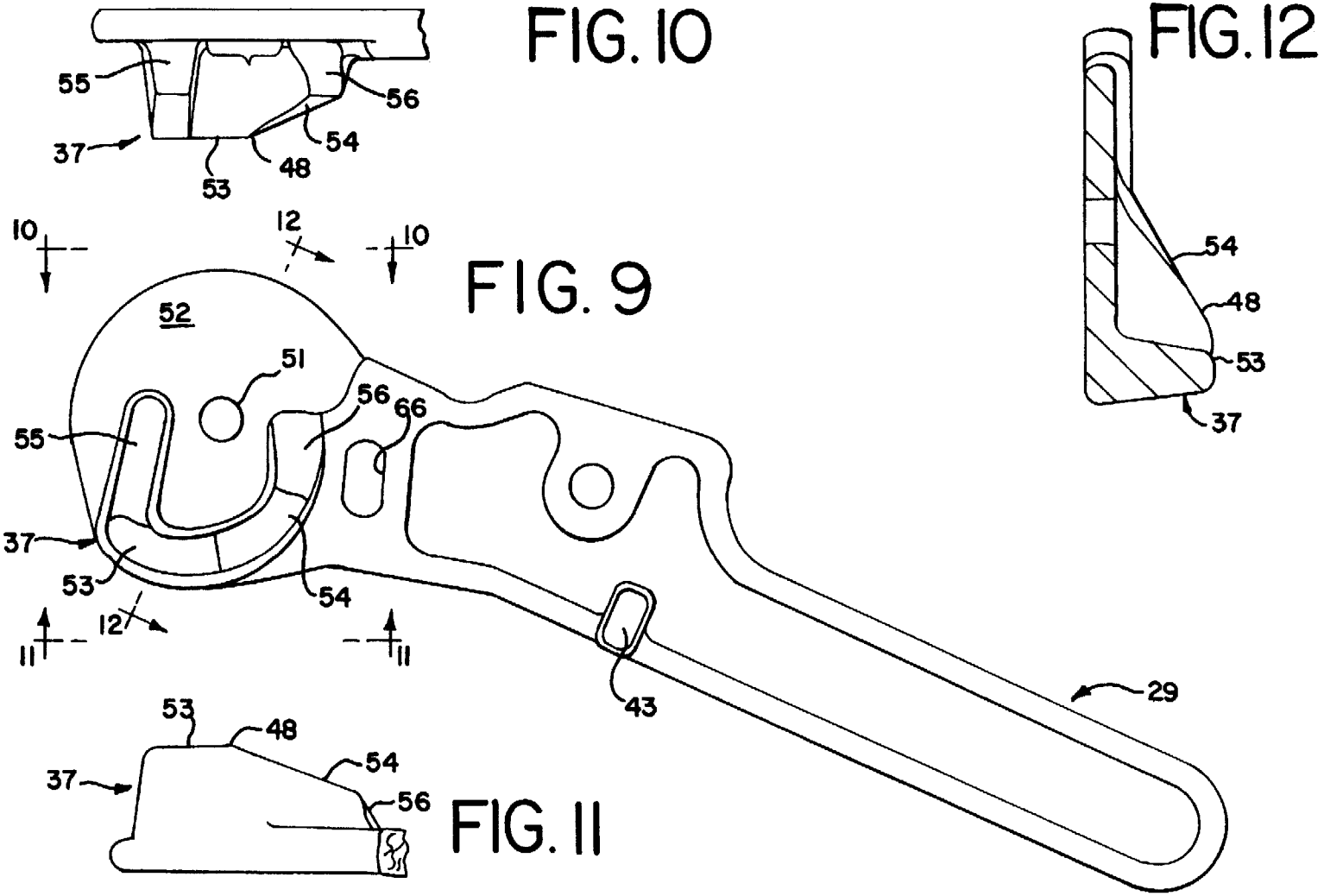
FIG. 9 is an elevational view of the illustrated handle component when viewed from its back side.
FIG. 10 is a top plan view taken along the line 10—10 of FIG. 9.
FIG. 11 is a bottom plan view taken along the line 11—11 of FIG. 9.
FIG. 12 is a cross-sectional view along the line 12—12 of FIG. 9.

With more particular reference to the shape of the curved cam surface 48, same has a generally U-shaped engagement surface. The cam component 37 has a somewhat horseshoe-shaped configuration. A preferred cam component 37 is shown in FIGS. 9, 10, 11 and 12 in order to exemplify the cam action between this cam component and other components of the hatch cover lock assembly. Handle member 29 is pivotally mounted to the front panel 33 of the housing member 28 through hole 51. FIG. 9 shows the back-side view of the illustrated handle member 29, with the handle being in its unlocked and open orientation. This is the orientation of the solid-lined handle which is found in FIG. 6.

As shown in FIGS. 9 through 12, the curved cam surface 48 is raised with respect to back or inside surface 52 of the handle member 29. The illustrated embodiment of this curved cam surface 48 includes a surface which is generally parallel to this inside surface 52, such being top surface 53. A curved ramp surface 54 generally connects the top surface 53 with the inside surface 52. Another ramp surface generally connects the opposite end of the top surface 53 with the inside surface 52. Such can take the form of the illustrated straight ramp surface 55. In the illustrated embodiment, one or both of the ramp surfaces can terminate at a secondary ramp surface. Illustrated in this regard is secondary ramp surface 56.

With reference to the camming action achieved by the illustrated embodiment, reference is first made to the open and unlocked position of handle member 29. This position is as shown in solid lines in FIG. 6. This is an at-rest position, and typically a portion of the handle member 29 will be resting on a non-moving component, such as side panel 34 of the housing member 28. At this location, the curved cam surface 48 engages the lower cam follower surface 49 of the keeper member 31. This is generally shown in FIG. 7. Typically, this engagement will be with the deepest component of the curved cam surface, such as the top surface 53 thereof. This type of engagement maintains the keeper member 31 in the open orientation depicted in FIG. 7, thereby preventing the keeper member 31 from blocking access to the receptor location, including access to the V-notches 45, 46.

Figure 6:
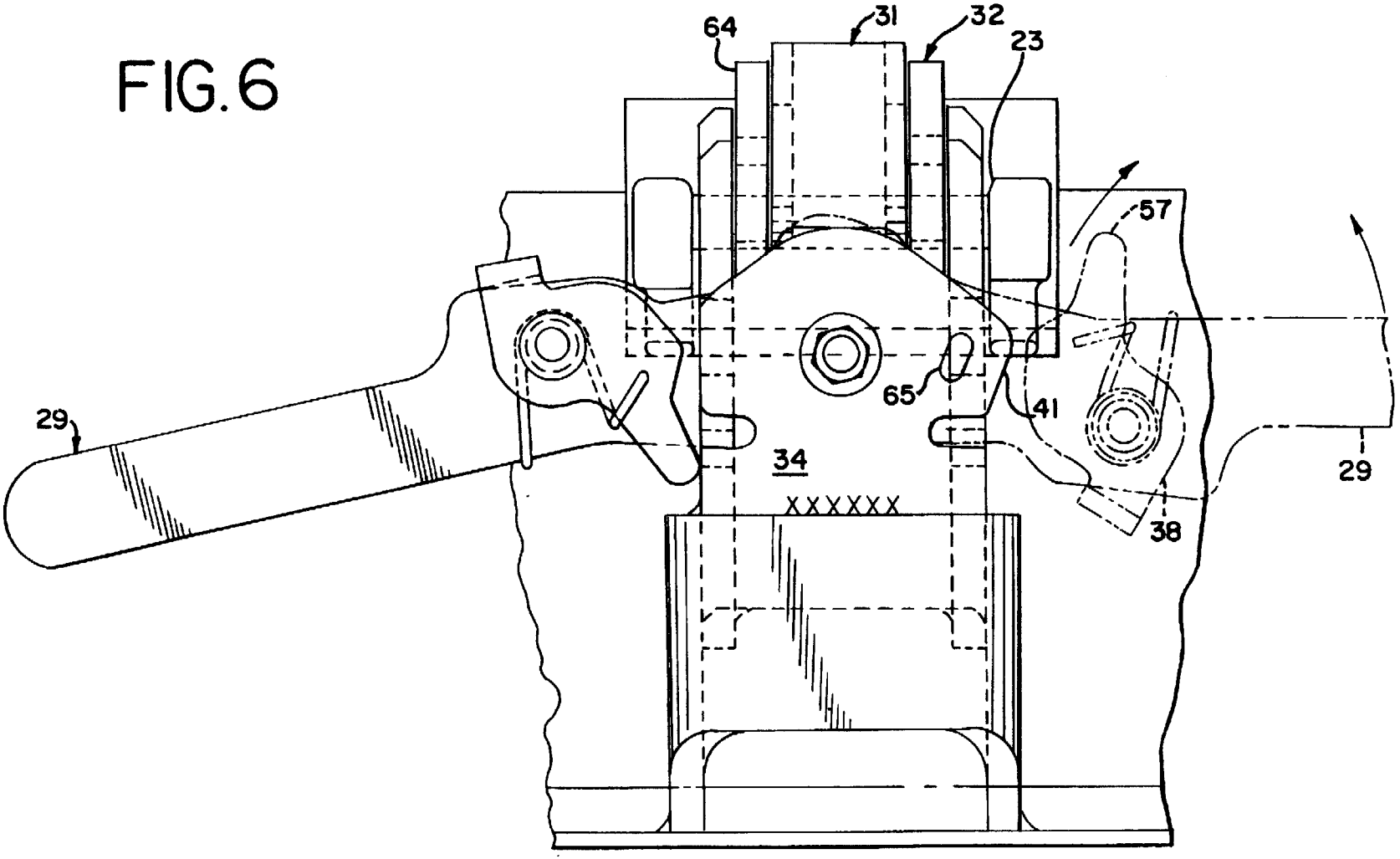
FIG. 6 is front elevational view similar to FIG. 4, and illustrating the unlocked orientation of the hatch cover lock.
Figure 7:
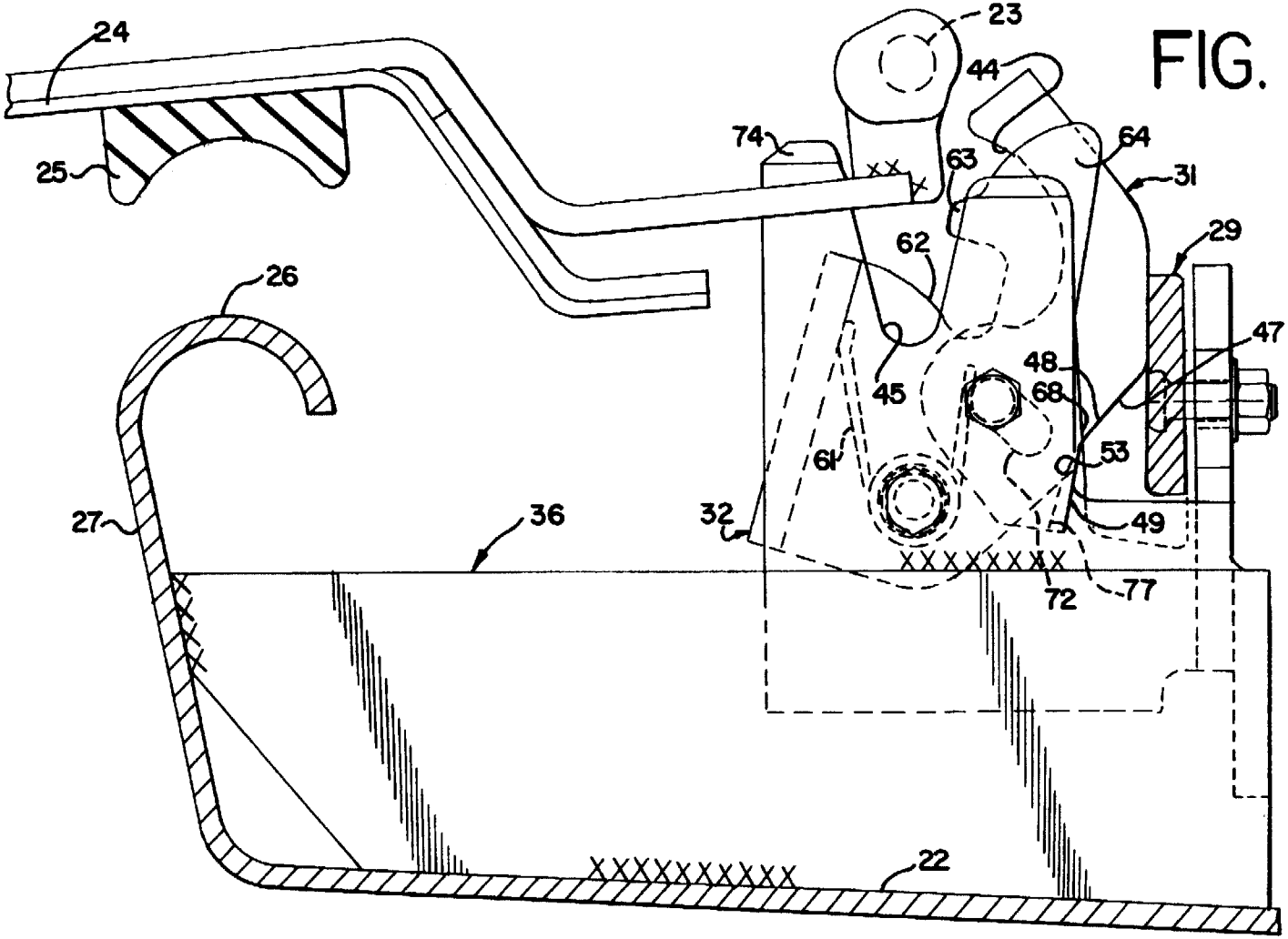
FIG. 7 is a side elevational view similar to FIG. 3, except the hatch cover lock is shown in its open and unlocked orientation.

When the operator begins to rotate the handle member 29 in the clockwise direction and toward the fully locked position of handle member 29 which is shown in phantom in FIG. 6, the ramp surface 54 (FIG. 11) of the curved cam surface 48 begins its camming engagement with the upper cam follower surface 47 (FIG. 7). Typically, this generally coincides with moving away from the camming engagement between the curved cam surface 48 and the lower cam follower surface 49 of keeper member 31. Engagement between the curved cam surface 48 and an angled edge 77 of the lower cam follower surface 49 assists in movement of the keeper member 31. During this continued movement of the handle member 29, the keeper member 31 begins to move toward its closed or locked position.

Figure 5:
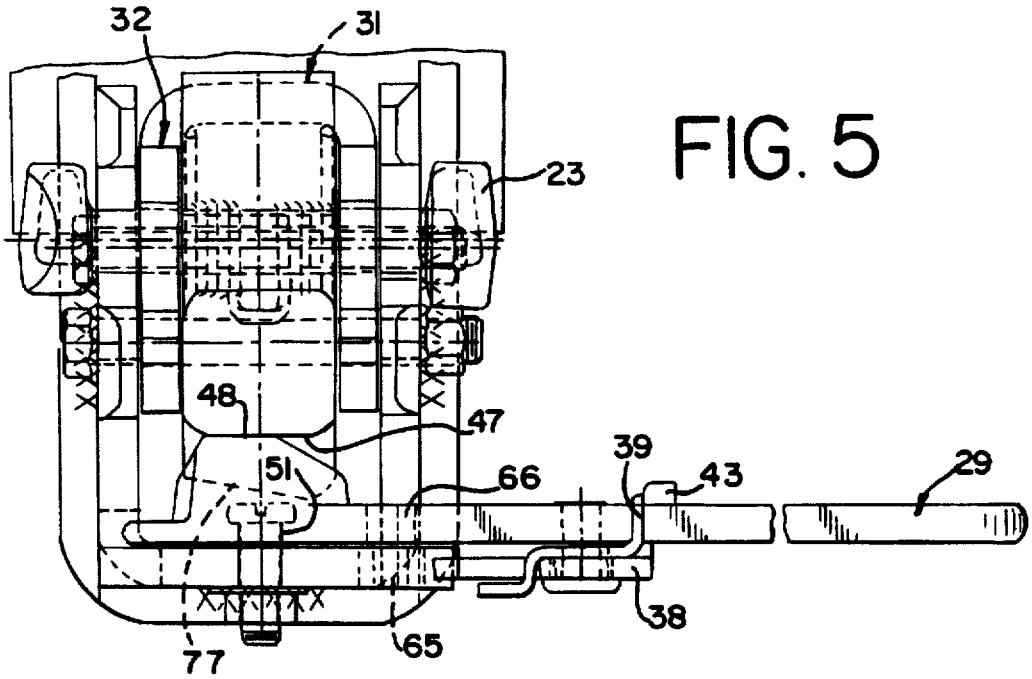
FIG. 5 is a plan view of the hatch cover lock as shown in FIG. 4.
Figure 4:
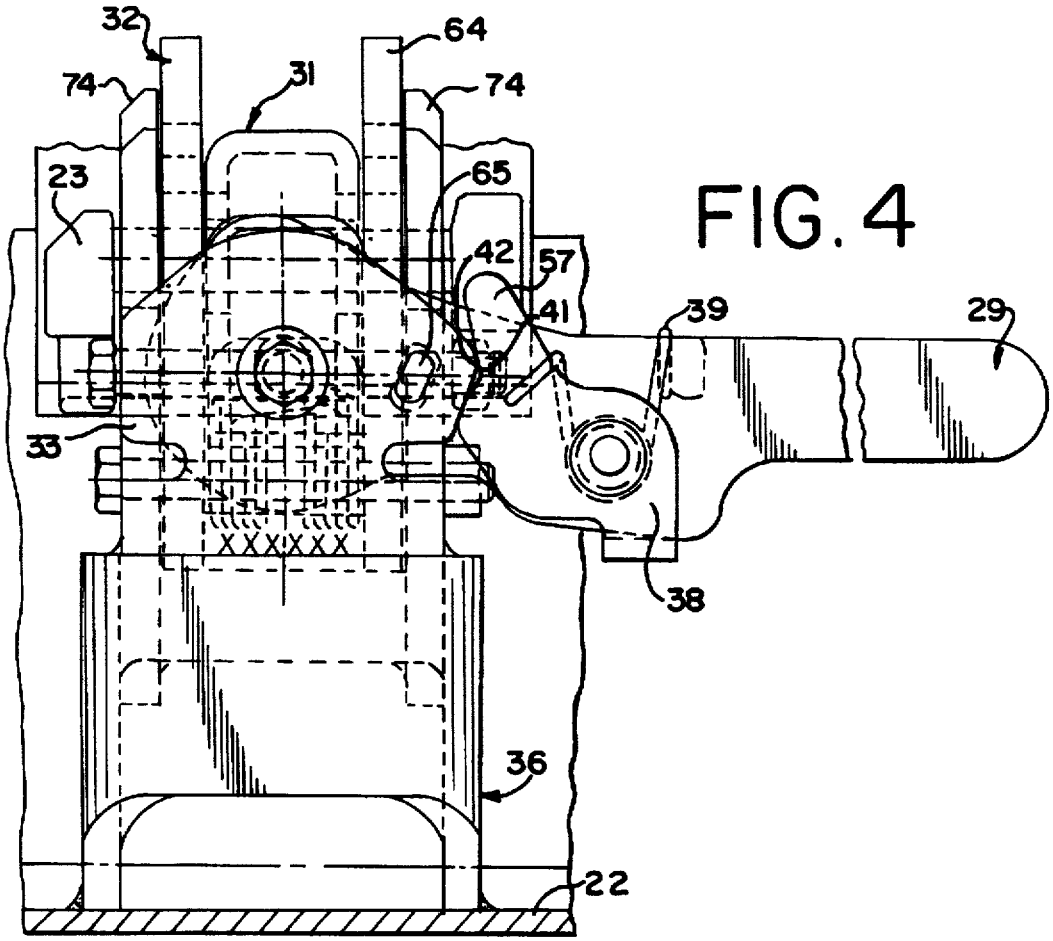
FIG. 4 is a front elevational view of the illustrated hatch cover lock, shown in its locked orientation.

This camming action continues until keeper member 31 moves to its fully closed position and the handle member 29 moves to its locked position, both as shown in FIGS. 1, 4 and 5. This movement of the keeper member 31 is shown in phantom in FIG. 3, with its fully closed position being in solid lines in FIG. 3. It will be noted that, in the illustrated embodiment, the top surface 53 of the curved cam surface 48 is in contacting relationship with the upper cam follower surface 47 of the keeper member 31.

When opening the hatch cover lock assembly, one pulls on projection 57 of the handle lock 38 so as to rotate same as generally shown by the adjoining arrow in FIG. 6. This rotates the handle lock 38 so as to clear same from the protruding surface 42 of housing member 28. Then, the handle member 29 can be rotated counterclockwise as shown in FIG. 6 to initiate camming action movement of the keeper member 31 from its fully closed position to its fully opened position. Essentially, the camming action just described with respect to closing of the keeper member 31 is generally reversed.

Once the keeper member 31 has been cammed open to allow access to the receptor location or area, the user can depress the retainer hook member 32 when it is desired to provide complete accessibility to the receptor location. This opening of the retainer hook member 32 can be accomplished by having the user grasp one or both of the manual release tabs or tongs 64 of the retainer hook member 32. Optionally, one or more laterally projecting handles 78 (FIG. 2) can be added to facilitate this grasping. This hook movement to gain access to the receptor location is facilitated by having the retainer hook member open in a direction away from the hatch cover. This allows for greater hand clearance when the user is disengaging the retaining hook member. In the context of opening the hatch cover lock apparatus, this means that the hinge pin 23 which had been locked into the receptor location is now free to be removed therefrom. Thus, the user can grasp and lift the hopper cover 24 or a hold-down 58 for a hatch cover.

In a typical application, once the hinge pin 23 is disengaged from the retainer hook member 32, the hopper cover is lifted slightly, and the hinge pin 23 is rested upon a notch 59 of the retainer hook member 32. Next, the hinge pin (not shown) at the opposite side of the hopper cover is similarly opened while this hinge pin 23 rests within the notch 59 and thus remains in proper position on the hatch cover lock assembly until both hinge pins are unlocked. As illustrated, the preferred retainer hook member has dual hook components for redundancy and balance of the retaining function and of the resting function. These dual hook components and notches 59 provide a more positive engagement with the hinge pin than does a single hook and notch.

Most hatch covers will have a plurality of the hatch cover lock assemblies, and in a typical application this unlocking process is repeated for all such lock assemblies along one longitudinal side of the hatch cover. Then, once all are unlocked, the hatch cover can be opened, typically by being pivoted on hinge pins retained and/or locked within hatch cover lock assemblies on the opposite longitudinal side of the hatch cover.

In the event that one or more of the hinge pins on the opposite longitudinal side of the hopper cover are not in fact retained and/or locked within the hook member 32, but such hinge pin is resting on notches 59, the action of opening the hopper cover and beginning to pivot same on the hinge pins (including this unsecured hinge pin) will cause the unsecured hinge pin to exert a force on the hook member 32. The result is a rotation of the hook member 32 from its retaining position and to an open position so as to provide access to the receptor location, with the result that the hinge pin falls into the receptor location. In the illustrated embodiment, a spring 61 (FIG. 3) biases the hook member 32 toward its closed position. Thus, this action just described is in opposition to the bias of the spring 61, and once the previously unsecured hinge pin falls into the receptor location, the spring 61 returns the hook member 32 to its closed orientation. It will be noted that this spring 61 as shown is hidden from view and is thus generally tamper proof.

Spring 61 is shown mounted onto a sleeve 75 which is rotatably mounted on a pivot rod 76 by which the hook member 32 also is pivotally mounted to the housing member 28. Advantageously, this sleeve 75 has a length and radial thickness so as to function also as a lateral spacer between opposing housing members.

In the event that the spring 61 is omitted or broken, this action of closing the rotainer hook member 32 onto the hinge pin 23 can be accomplished nevertheless. To achieve this objective, the retainer hook member 32 includes a trigger leg surface 62. Referring to FIG. 7, when the hinge pin 23 moves toward the receptor location, into the V-notches 45, 46 in the illustrated embodiment, the hinge pin 23 will contact the trigger leg surface(s) 62, thereby rotating the hook member 32 in a counter-clockwise direction as shown in FIG. 7, such occurring after the hinge pin has cleared hook projection 63 of the retainer hook member 32. This contact and counter-clockwise rotation positions the hook projection 63 over the hinge pin 23 in order to thereby retain the hinge pin within the otherwise unlocked hatch cover lock. This helps to prevent the hatch cover from being inadvertently thrown off of the hopper car.

Movement of the retainer hook member 32 is preferably limited by having a member, such as pivot rod 71 by which the keeper member 31 is mounted to the housing member 28, pass through an elongated slot 72 of the retainer hook member 32. This combination is particularly useful in preventing the retainer hook member from rotating or falling too far when opening. For example, one end 73 of slot 72 will engage the pivot rod 71 to prevent excess hook rotation. It will be appreciated that, should retainer hook member 32 open too far, the proper operation of the trigger leg surface (s) 62 discussed above could be compromised because the hinge pin 23 might not properly engage the trigger leg surface(s) 62 to close the retainer hook member 32.

In a somewhat related situation, in the event that the spring 61 is non-operational or does not possess adequate spring strength in order to close the retainer hook member 32 in opposition to debris or dirt build up or the like, the cam component 37 of the handle member 29 is able to strike the retainer hook member 32 and move it toward its closed position. More particularly, retainer hook member 32 is shown with a widened area 68 (FIG. 3 and FIG. 7). This widened area 68, when retainer hook member is in its open position as illustrated in FIG. 7, will be struck by at least top surface 53 of the curved cam surface 48, thereby urging the retainer hook member to move in a closing direction. Preferably, this action shifts the retainer hook member 32 so that its center of gravity causes it to fall toward its closed position in the absence of any assistance from spring 61.

With the hatch cover lock assembly in its locked position, such as shown in FIGS. 1, 4 and 5, a seal access hole 65 in housing member 28 registers with a hole 66 in handle member 29. A seal device or tamper-indicating device of a type generally known (not shown) can then be passed through both holes 65 and 66. With this arrangement, the seal device or tamper indicator does not interfere with operation of the keeper member 31 or of the retainer hook member 32.

Figure 8:
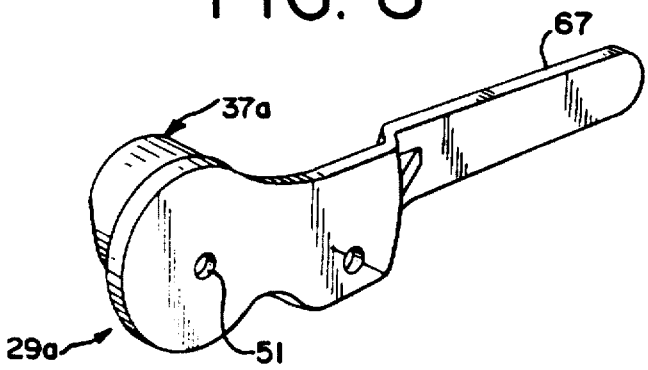
FIG. 8 is a perspective view of an alternative embodiment of a handle component of the illustrated hatch cover lock.

FIG. 8 shows an alternative handle member, generally designated as **29*a*. It incorporates an offset handle construction wherein the free end portion 67 of the handle member is offset or spaced inwardly with respect to the rest of the handle member. This arrangement provides a greater clearance with respect to the running board of the railway hopper car. Also, the cam component 37*a*** can be a replaceable element, constructed separately of the rest of the handle member, in order to accommodate wear of the camming surface.

It will be understood that the embodiments of the present invention which have been described are illustrative of some of the applications of the principles of the present invention. Various modifications may be made by those skilled in the art without departing from the true spirit and scope of the invention.

I claim:

1. A cam-operated hatch cover lock for securing an openable roof member of a railway hopper car, the hatch cover lock comprising:

a housing member, said housing member being adapted to secure the hatch cover lock to a railway hopper car at a location therealong for engaging and receiving a hopper cover narrow member of an openable roof member;

a receptor location associated with said housing member, said receptor location being adapted to receive the narrow member;

a retainer hook member adapted to automatically provide access of the narrow member to said receptor location and to automatically retain the narrow member within said receptor location;

a handle member pivotally mounted to the housing member, said handle member having a pivot axis and a camming surface; and a keeper member, a cam follower surface of the keeper member, said keeper member being adapted to lock the narrow member within said receptor location upon camming engagement of its said cam follower surface by said camming surface of the handle member, said keeper member having a locking surface adapted to engage and lock down the narrow member when the hatch cover lock is in a locked orientation, said keeper member being pivotable about an axis generally perpendicular to said pivot axis of the handle member, and said locking surface faces away from said handle member.

2. The hatch cover lock in accordance with claim 1, wherein said camming surface of the handle member is a generally U-shaped camming surface on a generally horseshoe-shaped component, said generally U-shaped camming surface slidably engaging said cam follower surface of the keeper member.

3. The hatch cover lock in accordance with claim 2, wherein the generally horseshoe-shaped component has a surface which varies in depth along its extent, with differing portions of the U-shaped camming surface engaging different portions of the cam follower surface of the keeper member during pivoting of said handle member.

4. The hatch cover lock in accordance with claim 1, wherein said camming surface of the handle member presents a curved camming surface that slidably engages said cam follower surface of the keeper member.

5. The hatch cover lock in accordance with claim 4, wherein said curved camming surface varies in depth along the camming surface.

6. The hatch cover lock in accordance with claim 5, wherein said curved camming surface includes a top surface, a first ramp surface extending beyond said top surface on one side of the top surface, and a second ramp surface extending on an opposite side of said top surface, and said top surface is of a greater depth than the greatest depth of either of said ramp surfaces.

7. The hatch cover lock in accordance with claim 5, wherein said cam follower surface of the keeper member includes an angled edge of a lower cam follower surface.

8. The hatch cover lock in accordance with claim 1, wherein said retainer hook member is pivotally mounted to said housing member along an axis generally parallel to the narrow member, said retainer hook member having a hook projection directed toward the openable roof member, and said retainer hook member pivots in a direction away from the openable roof member when moving from its position to retain the narrow member and to a position to permit passage of the narrow member into and out of said receptor location.

9. The hatch cover lock in accordance with claim 1, wherein said retainer hook member has an elongated slot therethrough, which elongated slot engages a member projecting inwardly from said housing member to thereby limit movement of the retainer hook member.

10. The hatch cover lock in accordance with claim 1, wherein said retainer hook member has a plurality of generally parallel hook projections, each projecting in a direction toward the openable roof member.

11. The hatch cover lock in accordance with claim 1, further including a spring biasing said retainer hook member to a closed orientation and in a direction toward the openable roof member.

12. The hatch cover lock in accordance with claim 1, wherein said retaining hook member includes a trigger leg surface which is within said receptor location when said retaining hook member is in an open condition, said trigger leg surface is adapted to be engaged by the narrow member when same enters the receptor location with said retainer hook member in its open orientation, whereupon said retaining hook member secures the narrow member at the receptor location.

13. The hatch cover lock in accordance with claim 1, wherein said keeper member is generally hook-shaped.

14. The hatch cover lock in accordance with claim 1, wherein said receptor location is generally defined by at least one notch within said housing member.

15. The hatch cover lock in accordance with claim 1, wherein said handle member has a main longitudinal portion and a free end longitudinal portion which is offset transversely with respect to said main longitudinal portion.

16. The hatch cover lock in accordance with claim 1, wherein said housing member has an upwardly projecting component having an inwardly directed surface for assisting in guiding the narrow member to said receptor location.

17. A cam-operated hatch cover lock for securing a removable roof member for a top hatch of a railway hopper car, the hatch cover lock comprising:

a housing member, said housing member being adaptable to secure the hatch cover lock to a railway hopper car at a location therealong for engaging and receiving a hatch cover narrow member of a removable roof member;

a notch within said housing member, said notch at least partially defining a receptor area which is sized and shaped to receive the narrow member;

a retaining hook member pivotally mounted with respect to said housing member along an axis generally parallel to the narrow member, said retaining hook member having a closed orientation for retaining the narrow member within the receptor area, said hook member having an open orientation at which the narrow member is free of interference from said retaining hook member to pass into or out of said receptor area;

a handle member pivotally mounted to the housing along an axis generally perpendicular to the narrow member, said handle member having a curved camming surface; and a keeper member pivotally mounted to said housing member along an axis generally parallel to the narrow member, said keeper member having a locking surface adapted to secure the narrow member within the receptor area when said keeper member is in a closed orientation, said keeper member adapted to permit the narrow member to be free from interference from said keeper member for passage in and out of said receptor area when said keeper member is in an open orientation, said keeper member having a cam follower surface which is engaged by said curved camming surface of the handle member to thereby effect camming engagement and movement of said keeper member between its said open position and its said closed position during pivoting movement of said handle member.

18. The cam-operated hatch cover lock in accordance with claim 17, wherein said cam surface of the handle member is a generally U-shaped camming surface on a generally horseshoe-shaped component to provide a generally U-shaped camming surface slidably engaging said cam follower surface of the keeper member.

19. The cam-operated hatch cover lock in accordance with claim 18, wherein the generally horseshoe-shaped component has a surface which varies in depth along its extent, with differing portions of the U-shaped camming surface engaging different portions of the cam follower surface of the keeper member during pivoting of said handle member.

20. The cam-operated hatch cover lock in accordance with claim 17, wherein said curved camming surface varies in depth along said camming surface.

21. The cam-operated hatch cover lock in accordance with claim 20, wherein said curved camming surface includes a top surface, a first ramp surface extending beyond said top surface on one side of the top surface, and a second ramp surface extending on an opposite side of said top surface, and said top surface is of a greater depth than either of said ramp surfaces.

22. The cam-operated hatch cover lock in accordance with claim 17, wherein said retaining hook member has a plurality of generally parallel hook projections, each projecting in a direction toward the openable roof member.

23. The cam-operated hatch cover lock in accordance with claim 17, wherein said retaining hook member includes a trigger leg surface which is within said receptor location when said retaining hook member is in an open condition, said trigger leg surface being adapted to be engaged by the narrow member when same enters the receptor location with said retainer hook member in its open orientation.

24. A cam-operated hatch cover lock for securing an openable roof member of a railway hopper car, the hatch cover lock comprising:

a housing member, said housing member being adapted to secure the hatch cover lock to a railway hopper car at a location therealong for engaging and receiving a hopper cover narrow member of an openable roof member;

a receptor location associated with said housing member, said receptor location being adapted to receive the narrow member;

a retainer hook member adapted to automatically provide access of the narrow member to said receptor location and to automatically retain the narrow member within said receptor location, said retainer hook member being pivotally mounted to said housing member along an axis generally parallel to the narrow member, said retainer hook member having a hook projection directed toward the openable roof member, and said retainer hook member pivots in a direction away from the openable roof member when moving from its position to retain the narrow member into a position to permit passage of the narrow member into and out of said receptor location;

a handle member pivotally mounted to the housing member, said handle member having a camming surface; and a keeper member, a cam follower surface of the keeper member, said keeper member being adapted to lock the narrow member within said receptor location upon camming engagement of its said cam follower surface by said camming surface of the handle member.

25. A cam-operated hatch cover lock for securing an openable roof member of a railway hopper car, the hatch cover lock comprising:

a housing member, said housing member being adapted to secure the hatch cover lock to a railway hopper car at a location therealong for engaging and receiving a hopper cover narrow member of an openable roof member;

a receptor location associated with said housing member, said receptor location being adapted to receive the narrow member;

a retainer hook member adapted to automatically provide access of the narrow member to said receptor location and to automatically retain the narrow member within said receptor location;

a spring biasing said retainer hook member to a closed orientation in a direction toward the openable roof member;

a handle member pivotally mounted to the housing member, said handle member having a camming surface; and a keeper member, a cam follower surface of the keeper member, said keeper member being adapted to lock the narrow member within said receptor location upon camming engagement of its said cam follower surface by said camming surface of the handle member.

* * * * *

UNITED STATES PATENT AND TRADEMARK OFFICE

CERTIFICATE OF CORRECTION

PATENT NO. : 5,785,362

DATED : July 28, 1998

INVENTOR(S) : Rudolph E. Nadherny

It is certified that error appears in the above-indentified patent and that said Letters Patent is hereby corrected as shown below:

Col. 7, line 23, "rotainer" should read --retainer--.

Signed and Sealed this

Seventeenth Day of November, 1998

Bruce Lehman

*Attest:*

BRUCE LEHMAN

*Attesting Officer*

*Commissioner of Patents and Trademarks*